US010362881B2

(12) United States Patent
An

(10) Patent No.: US 10,362,881 B2
(45) **Date of Patent: *Jul. 30, 2019**

(54) COLLAPSIBLE, FOLDING MATTRESS SUPPORT WITH A HEADBOARD AND A FOOTBOARD THAT FOLD OUT

(71) Applicant: Best Price Mattress Inc., Union City, CA (US)

(72) Inventor: Hyung Hwan An, San Ramon, CA (US)

(73) Assignee: Best Price Mattress Inc., San Leandro, CA (US)

( * ) Notice: Subject to any disclaimer, the term of this patent is extended or adjusted under 35 U.S.C. 154(b) by 21 days.

This patent is subject to a terminal disclaimer.

(21) Appl. No.: 15/876,149

(22) Filed: Jan. 20, 2018

(65) Prior Publication Data

US 2018/0140104 A1 May 24, 2018

Related U.S. Application Data

(63) Continuation of application No. 14/929,202, filed on Oct. 30, 2015, now Pat. No. 9,907,405.

(51) Int. Cl.

| | |
|---|---|
| ***A47C 19/12*** | (2006.01) |
| ***A47C 19/02*** | (2006.01) |
| ***A47C 17/00*** | (2006.01) |
| ***A47C 17/64*** | (2006.01) |
| ***A61G 7/002*** | (2006.01) |

(Continued)

(52) U.S. Cl.

CPC ..... *A47C 19/122* (2013.01); *A47C 17/40* (2013.01); *A47C 17/68* (2013.01); *A47C 19/12* (2013.01); *A47C 19/02* (2013.01); *A61G 7/002* (2013.01)

(58) Field of Classification Search

CPC ..... A47C 19/12; A47C 19/122; A47C 19/126; A47C 19/128; A47C 17/40; A47C 17/68; A47C 19/02; A47C 17/00; A47C 17/64; A61G 7/002

See application file for complete search history.

(56) References Cited

U.S. PATENT DOCUMENTS

| | | | | |
|---|---|---|---|---|
| 1,196,253 A | 8/1916 | Lowy | ..... | A47C 19/122 5/154 |
| 1,631,081 A | 5/1927 | Bennett | ..... | A47C 17/40 292/36 |

(Continued)

*Primary Examiner* — Robert G Santos
*Assistant Examiner* — Rahib T Zaman
(74) *Attorney, Agent, or Firm* — Imperium Patent Works; Darien K. Wallace

(57) ABSTRACT

A foldable mattress support includes a headboard, a central hinge portion and first and second portions of a bedboard frame. The first and second portions are pivotally attached to the central hinge. A longer first strut is pivotally attached at a first location to a side bar of the first portion and at a third location to a post of the headboard. A shorter second strut is pivotally attached at a second location to the side bar and at a fourth location to the post. The second location is closer to the head end of the first portion than is the first location, and the fourth location is closer to the top of the post than is the third location. The struts rotate the headboard from an unfolded state that is perpendicular to the first portion down to being parallel and adjacent to the first portion in a collapsed state.

20 Claims, 9 Drawing Sheets

(51) Int. Cl.
*A47C 17/40* (2006.01)
*A47C 17/68* (2006.01)

(56) References Cited

U.S. PATENT DOCUMENTS

| | | | | |
|---|---|---|---|---|
| 2,542,744 | A | 2/1951 | Willens et al. | A47C 17/68 5/111 |
| 2,678,085 | A | 5/1954 | De Minno | A47C 20/043 297/383 |
| 2,976,545 | A | 3/1961 | Vanderminden | A47C 17/68 5/111 |
| 4,970,737 | A | 11/1990 | Sagel | A47C 20/08 5/201 |
| 6,009,575 | A | 1/2000 | Hsieh | A47C 17/70 5/114 |
| 8,407,837 | B1 | 4/2013 | Huang et al. | A61G 7/002 5/116 |
| 8,935,817 | B2 | 1/2015 | Suh | A47C 19/122 5/174 |
| 2004/0055085 | A1 | 3/2004 | Boscaro | A47C 19/122 5/110 |
| 2008/0276872 | A1 | 11/2008 | Chern | A01K 1/0353 119/28.5 |
| 2010/0005587 | A1 | 1/2010 | Choi | A47C 19/122 5/202 |
| 2011/0099712 | A1 | 5/2011 | Jin | A47C 19/122 5/174 |
| 2011/0126352 | A1 | 6/2011 | Choi | A47C 19/122 5/176.1 |
| 2013/0276228 | A1 | 10/2013 | Hsieh | A47C 17/162 5/400 |
| 2013/0312185 | A1 | 11/2013 | Suh | A47C 20/043 5/618 |
| 2015/0320225 | A1* | 11/2015 | Boyd | A47C 19/04 5/202 |
| 2016/0157622 | A1 | 6/2016 | Oh | A47C 19/122 5/203 |

* cited by examiner

COLLAPSIBLE, FOLDING MATTRESS SUPPORT WITH A HEADBOARD AND A FOOTBOARD THAT FOLD OUT

CROSS REFERENCE TO RELATED APPLICATION

This application is a continuation of, and claims priority under 35 U.S.C. § 120 from, nonprovisional U.S. patent application Ser. No. 14/929,202 entitled "A Collapsible, Folding Mattress Support with a Headboard and a Footboard that Fold Out," filed on Oct. 30, 2015, now U.S. Pat. No. 9,907,405, the subject matter of which is incorporated herein by reference.

TECHNICAL FIELD

The present invention relates to bedding products, and in particular to a collapsible, folding mattress support with a headboard and a footboard that fold out from under a bedboard frame.

BACKGROUND INFORMATION

Conventional beds generally include a mattress resting on a box springs that is supported by a bed frame. Box springs are generally designed to have the outward appearance of a mattress, being covered by quilted fabric and cushioning, for example. Typically, box springs have a wooden rectangular frame supporting an array of springs to provide firm support for the mattress.

A box springs is usually constructed in one piece having the same dimensions as the mattress it supports. A conventional box springs, due to its stiff wooden frame, is often heavy and awkward to handle. The dimensions of a conventional box spring make it impractical for a consumer to transport the box springs home from a mass-market retail store. For example, the typical box springs does not fit in the trunk of a car. Moving such a box-springs into apartment elevators and around corners into bedrooms is often difficult and exposes the box springs and doorways to potential damage. In addition, the dimensions of a conventional box springs take up valuable retail floor space which discourages mass-market stores from offering box springs to their retail customers.

Attempts have been made to develop folding mattress supports in the form of collapsible box springs or collapsible bed frames upon which a mattress can be directly placed. For example, FIG. 1 (prior art) shows a foldable bedding foundation 10 as disclosed in U.S. Pat. No. 7,376,988. Bedding foundation 10 has wire struts 11 that pivotally secure an upper wire grid 12 to wooden rails of the base 13. Wire braces 14 slide along the wire struts 11 and hold the bedding foundation 10 in an erected position when the foundation is unfolded. The two portions of the upper wire grid 12 are connected to each other by an upper hinge 15. Upper hinge 15 is a small piece of plastic that clips onto the border wires of each of the two portions of the upper wire grid 12. The two portions of the base 13 are connected to each other by a lower hinge 16, which is a piece of wire. Upper hinge 15 and lower hinge 16 are not attached to each other. The wire braces that slide along wire struts and the upper wire grids that are clipped together with a plastic hinge render bedding foundation 10 less sturdy than a conventional box springs. Moreover, bedding foundation 10 lacks a headboard and a footboard, so most consumers would prefer to place foundation 10 on another bed foundation whose aesthetic appearance more resembles a bed.

A support for a mattress is sought that provides all of the support, comfort and aesthetic qualities of a conventional box springs supported by a bed foundation but yet that reduces the transportation and storage space requirements of a conventional bed and box springs combination. Moreover, the novel mattress support should be less flimsy than a foldable bed foundation that employs wire braces, wire struts, wire hinges and wire grids that are clipped together.

SUMMARY

A foldable mattress support includes a headboard frame, a central hinge portion, first and second portions of a bedboard frame and bracing struts. The headboard frame is parallel to the first portion when the foldable mattress support is completely collapsed and perpendicular to the first portion when the foldable mattress support is completely unfolded. The first portion and the second portion are pivotally attached to the central hinge portion. A first bracing strut is pivotally attached at a first location to a side bar of the first portion, and a second bracing strut is pivotally attached at a second location to the side bar. The first location and the second location are located on opposite sides of the side bar. The first bracing strut is longer than the second bracing strut. The second location is closer to the head end of the first portion than is the first location. The first bracing strut is pivotally attached at a third location to a post of the headboard frame, and the second bracing strut is pivotally attached at a fourth location to the post. The fourth location is closer to the top end of the post than is the third location. The first location is closer to the second location than the third location is to the fourth location. The bracing struts are used to rotate the headboard frame from a collapsed state that is parallel and adjacent to the first portion to an unfolded state that is perpendicular to the first portion without pivoting the headboard frame about any axis whose position is fixed with respect to the first portion.

A footboard frame that is analogously attached to bracing struts is rotated from a collapsed state that is parallel and adjacent to the second portion to an unfolded state that is perpendicular to the second portion. When the mattress support is completely collapsed, the first portion is substantially parallel to the second portion with the headboard frame and footboard frame sandwiched between the two portions of bedboard frame. The posts of the headboard frame and the footboard frame are parallel to the legs of the central hinge portion when the foldable mattress support is completely unfolded. The bracing struts permit the headboard frame to be completely folded under the first portion of the bedboard frame without extending out beyond the head end despite the fact that the posts of the headboard frame are nearly as long as the side bars of first portion. For example, the posts of the headboard frame can be more than three quarters as long as the side bars of the first portion.

A method of making and packaging a foldable mattress support includes folding down a headboard and a footboard and then folding a bedboard frame in half. A headboard frame is folded parallel to a first portion of the bedboard frame. The headboard is folded from a perpendicular orientation down and around the head end of the bedboard frame to being parallel and adjacent to the first portion. The folding is performed using bracing struts. A first bracing strut is pivotally attached at a first location to the first portion and at a third location to the headboard frame. A second bracing strut is pivotally attached at a second location to the first portion and at a fourth location to the headboard frame. The first bracing strut is longer than the second bracing strut. The first location is closer to the second location than the third location is to the fourth location. The footboard frame is also folded parallel and adjacent to the second portion.

The first portion of the bedboard frame is then folded into the second portion of the bedboard frame. The first and second portions are pivotally attached to a central hinge portion. The first portion is pivotally attached at its center end to the central hinge portion. The second location is closer to the head end of the first portion than is the first location.

The folded bedboard frame with the headboard and footboard sandwiched between the first and second portions is then inserted into a packing box. Instructions are also inserted into the packing box that instruct the user of the foldable mattress support to unfold the folded bedboard frame such that the headboard frame is perpendicular to the first portion.

Further details and embodiments are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

FIG. 5A shows the headboard adjacent to the bedboard frame before being unfolded. FIG. 5B shows the headboard being folded out from under the bedboard frame. FIG. 5C shows the headboard being folded out farther than in FIG. 5B. FIG. 5D shows the headboard being rotated towards a more vertical orientation. FIG. 5E shows the headboard being folded out and rotated into an almost vertical orientation. FIG. 5F shows the headboard in the completely unfolded state perpendicular to the bedboard frame.

DETAILED DESCRIPTION

Figure 1:
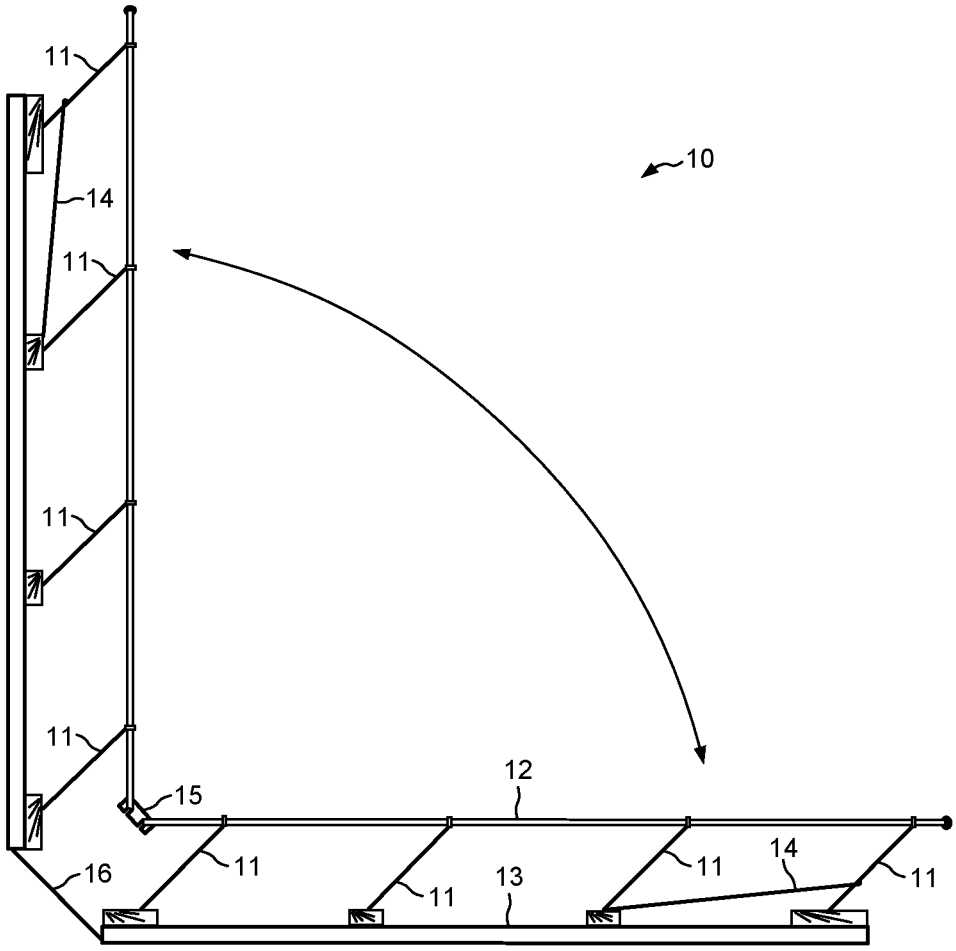
(PRIOR ART) FIG. 1
FIG. 1 (prior art) is a schematic diagram of a foldable bedding foundation that includes wire braces, wire struts, wire hinges and wire grids.
Figure 2:
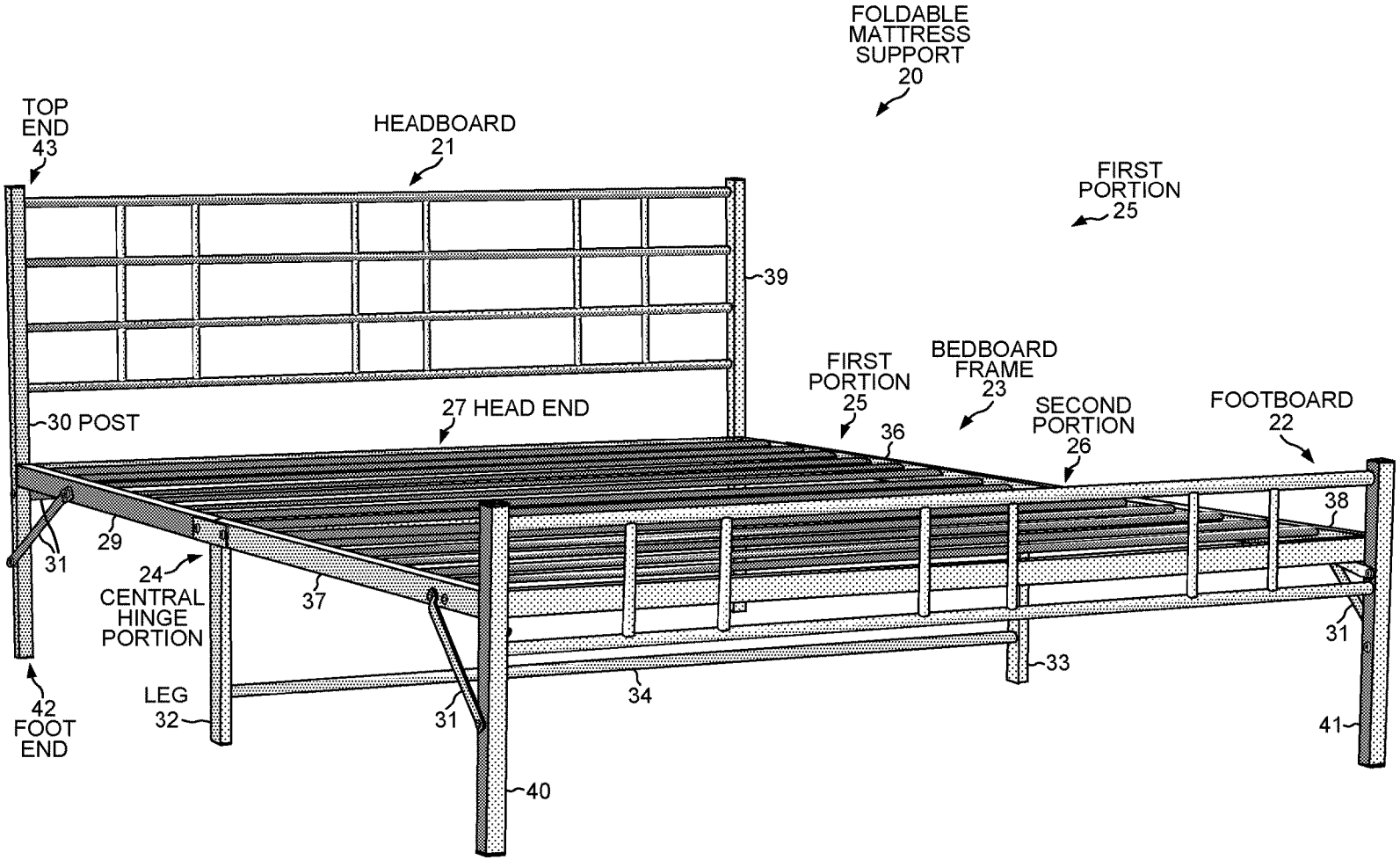
FIG. 2 is a perspective view of a novel collapsible, foldable mattress support that has the appearance of a conventional bed with a headboard, a footboard and a bedboard frame.

FIG. 2 shows a sturdy, collapsible, foldable mattress support 20 that has the appearance of a conventional bed frame with a headboard frame 21 and a footboard frame 22. The headboard frame 21 and the footboard frame 22 fold out from under a bedboard frame 23. Foldable mattress support 20 has a central hinge portion 24 at its middle axis at which a first portion 25 of bedboard frame 23 unfolds from a second portion 26 of the bedboard frame. First portion 25 has a head end 27 and a center end 28. In a completely unfolded state, the head end 27 of first portion 25 contacts headboard frame 21 when the head end of a side bar 29 of first portion 25 abuts a post 30 of headboard frame 21. In the completely unfolded state as shown in FIG. 2, headboard frame 21 is perpendicular to first portion 25 of bedboard frame 23. Similarly, in the completely unfolded state, footboard frame 22 is perpendicular to second portion 26. As the headboard frame 21 and footboard frame 22 are unfolded from under the bedboard frame 23, they are guided by bracing struts 31 from being parallel to the first and second portions of the bedboard frame to being perpendicular to the first and second portions of the bedboard frame.

Central hinge portion 24 has two legs 32-33 connected by a bar 34. In addition, central hinge portion 24 has plates that form hinges that pivotally attach the side bars of the first and second portions of the bedboard frame 23. Two of the plates are connection by a beam 35 (not visible in FIG. 2). First portion 25 has side bars 29 and 36, and second portion 26 has side bars 37-38. Headboard frame 21 has posts 30 and 39, and footboard frame 22 has posts 40-41. In the unfolded and assembled state, bar 29 abuts against post 30, bar 36 abuts against post 39, bar 37 abuts against post 40, and bar 38 abuts against post 41. The bars of bedboard frame 23 contact the posts of headboard frame 21 closer to a foot end 42 than to a top end 43 of the headboard frame. FIG. 2 shows that post 30 of headboard frame 21 is parallel to leg 32 of central hinge portion 24 when foldable mattress support 20 is completely unfolded.

In the description and claims, terms such as "over", "under", "top", "bottom", "up", and "down" are used to describe relative directions and orientations between different parts of the mattress support system, and it is to be understood that the overall structure being described can actually be oriented in any way in three-dimensional space. For example, when the headboard is described as being unfolded out from under the bedboard frame, it is to be understood that the headboard may in fact be folded down and over the end of the bedboard frame or even around the end of the bedboard frame. When a first object is referred to as being disposed "over" or "on" a second object, it is to be understood that the first object can be directly on the second object, or an intervening object may be present between the first and second objects.

Figure 3:
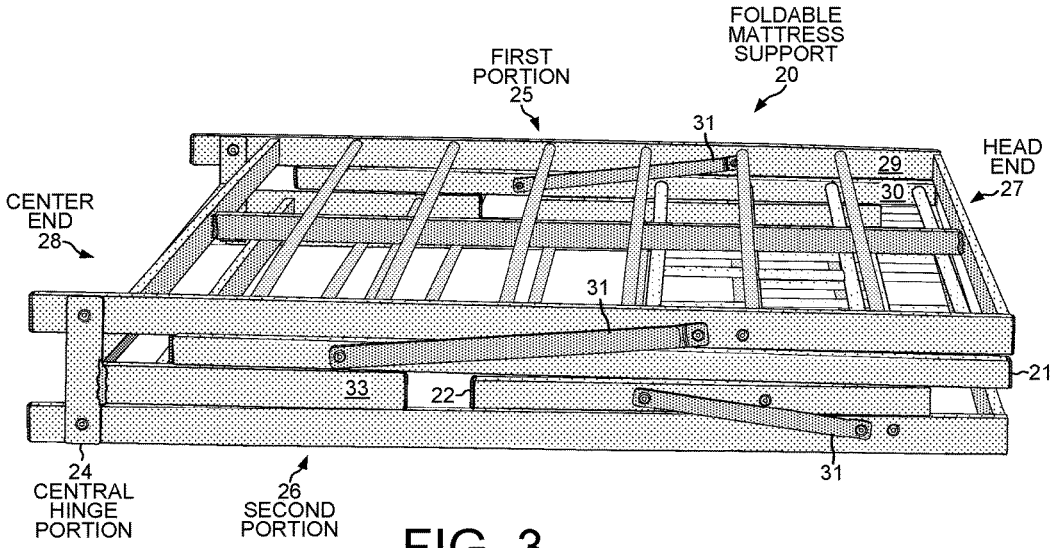
FIG. 3 is a perspective view of the mattress support of FIG. 2 in a completely collapsed state.

FIG. 3 shows mattress support 20 of FIG. 2 in a completely collapsed or folded state. In the folded state, mattress support 20 is very compact and occupies less than half the volume of a conventional box springs sized for the same mattress size as mattress support 20. When mattress support 20 is completely collapsed, first portion 25 is substantially parallel to the second portion 26 with the headboard frame and footboard frame sandwiched between the two portions of bedboard frame 23. The novel use of the bracing struts 31 permit headboard frame 21 to be completely folded under first portion 25 of bedboard frame 23 without extending out beyond head end 27, despite the fact that the posts 30 and 39 of headboard frame 21 are nearly as long as the side bars of first portion 25. In the embodiment of FIG. 2, for example, post 30 of headboard frame 21 is more than three quarters as long as side bar 29 of first portion 25.

The predetermined lengths and pivoting axes of the bracing struts 31 allow headboard frame 21 to rotate from an unfolded state that is perpendicular to first portion 25 to a collapsed state that is parallel and adjacent to first portion 25 without pivoting headboard frame 21 about any axis whose position is fixed with respect to first portion 25. Because bedboard frame 23 does not meet headboard frame 21 at the foot end 42 or top end 43, it would not be possible to fold headboard frame 21 completely under first portion 25 if headboard frame 21 were to pivot about any axis that is fixed compared to first portion 25, such as if a simple rotating hinge were to connect side bar 29 to post 30. By manufacturing the mattress support 20 so that it can fold flat with headboard frame 21 between the portions of bedboard frame 23, the mattress support can be packaged in a smaller box whose dimensions are more likely to fit in the trunk of a car. Thus, mattress support 20 is better suited than a conventional box springs for sale in mass-market retail stores. The smaller packing box containing the collapsed mattress support 20 can more easily be brought from the store shelf to the check-out counter and then to the trunk of the consumer's car. In addition, it is easier to move collapsed mattress support 20 into an apartment elevator, up a staircase or through bedroom doors.

Figure 4:
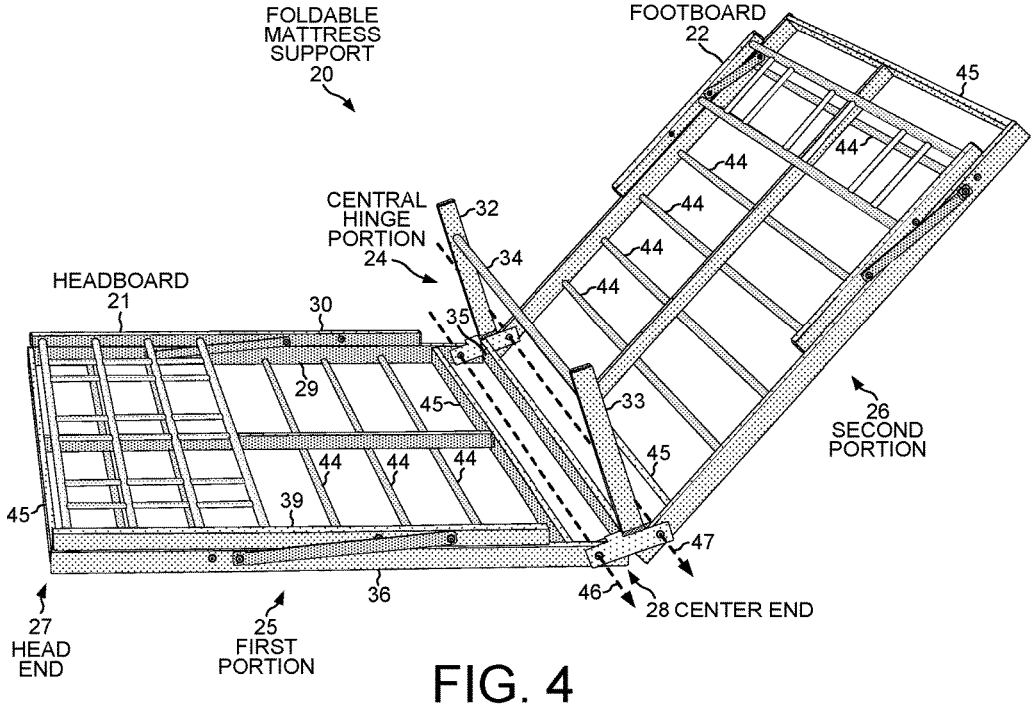
FIG. 4 is a perspective view of the mattress support of FIG. 3 in which a first portion of the bedboard is being unfolded from a second portion of the bedboard.

FIG. 4 illustrates how mattress support 20 is initially unfolded after being removed from a packing box in the completely collapsed state of FIG. 3. The consumer first unfolds second portion 26 from first portion 25. Each of the first and second portions has two side bars that are connected by six tubular bars 44 and two beams 45 at the ends. First portion 25 and second portion 26 are both pivotally attached to central hinge portion 24. However, the two portions 25-26 of bedboard frame 23 rotate about two separate axes 46-47, respectively, that pass through plates of the central hinge portion 24. First portion 25 is pivotally attached at axis 46 at its center end 28 to central hinge portion 24. FIG. 4 shows beam 35 that connects two of the inner plates of hinge portion 24. FIG. 4 also shows that each of the posts 30 and 39 of headboard frame 21 is more than three quarters as long as each of the side bars 29 and 36 of first portion 25. Headboard frame 21 is thereby sufficiently tall to be distinguishable from footboard 22 and to impart the aesthetic appearance of a traditional bed frame.

Figure 5A:
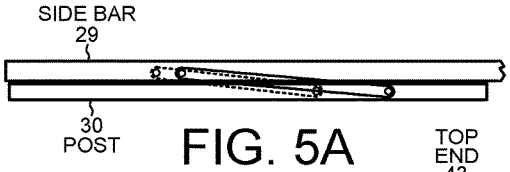
FIGS. 5A-F are schematic diagrams of six side views of the bedboard and the headboard as the mattress support of FIG. 3 is unfolded after being unpacked from a packing box.

FIGS. 5A-F are schematic diagrams of six side views of first portion 25 of foldable mattress support 20 as headboard frame 21 is being folded out from under bedboard frame 23. FIG. 5A shows post 30 of headboard frame 21 adjacent to and parallel to side bar 29 of first portion 25 as shown in FIG. 4 before headboard frame 21 is unfolded.

Figure 5B:
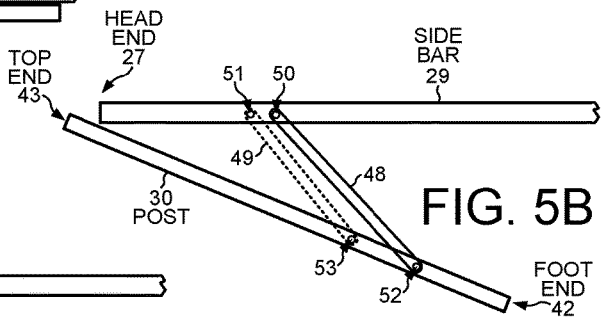

FIG. 5B shows post 30 of headboard frame 21 being folded out from under bedboard frame 23. The term "under" is used to describe only a relative position. In use, headboard frame 21 is unfolded by the consumer while mattress support 20 is positioned on its side. Thus, headboard frame 21 is actually unfolded around head end 27 of first portion 25. FIG. 5B shows a first bracing strut 48 and a second bracing strut 49 that are pivotally attached both to side bar 29 of first portion 25 and to post 30 of headboard frame 21. First bracing strut 48 is longer than second bracing strut 49. First bracing strut 48 is pivotally attached at a first location 50 to side bar 29, and second bracing strut 49 is pivotally attached at a second location 51 to side bar 29. Second location 51 is closer to head end 27 of first portion 25 than is first location 50. First bracing strut 48 is pivotally attached at a third location 52 to post 30 of headboard frame 21, and second bracing strut 49 is pivotally attached at a fourth location 53 to post 30. Fourth location 53 is closer to top end 43 of post 30 than is third location 52. In addition, first location 50 is closer to second location 51 than third location 52 is to fourth location 53.

First location 50 and second location 51 are located on opposite sides of side bar 29, and third location 52 and fourth location 53 are located on opposite sides of post 30. In the embodiment of FIG. 2, first bracing strut 48 is pivotally attached to the outside surfaces of bar 29 and post 30, whereas second bracing strut 49 is pivotally attached to surfaces of bar 29 and post 30 that do not face outwards from mattress support 20. In FIG. 5, second bracing strut 49 has a dashed outline to represent that the strut rotates on the other side of side bar 29 from the viewer. In addition to first bracing strut 48 and second bracing strut 49 that rotatably connect post 30 to side bar 29, two analogous bracing struts connect each of posts 39-41 to the side bars 36-39. The bracing struts are pivotally attached to the bars and posts by bolts, nuts and washers. The struts are made of flat bars of metal.

Figure 5C:
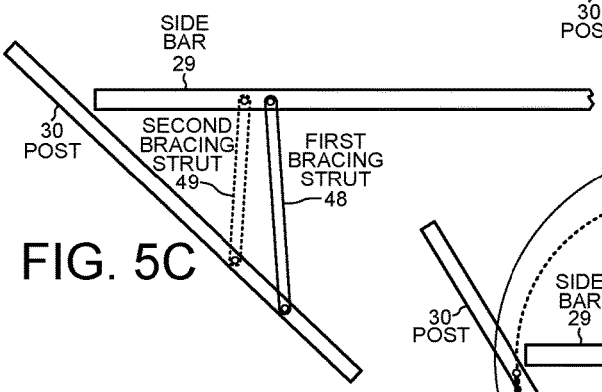

FIG. 5C shows post 30 of headboard frame 21 being folded out farther from under side bar 29 than in FIG. 5B. Because first bracing strut 48 is longer than second bracing strut 49, and pivot axis locations 50-51 are closer together than are pivot axis locations 52-53, foot end 42 of headboard frame 21 is pushed downward relative to top end 43 as the headboard frame is moved towards the head end 27 of bedboard frame 23. When the bracing struts 48-49 are more or less vertical as shown in FIG. 5C, top end 43 of headboard frame 21 is already above head end 27 of bedboard frame 23.

Figure 5D:
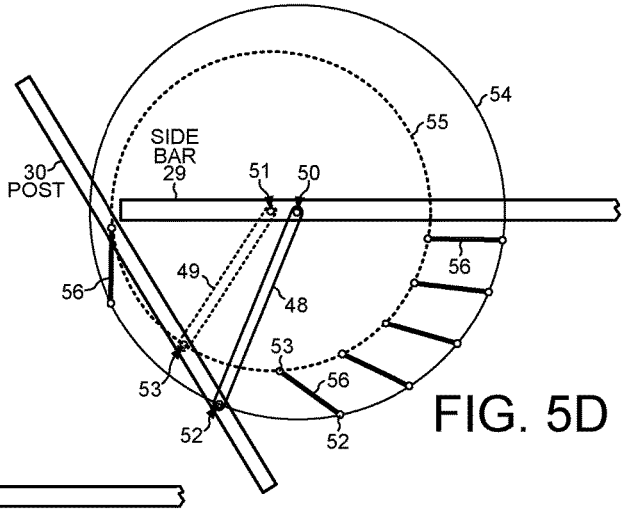

FIG. 5D shows headboard frame 21 being rotated towards a more vertical orientation than in FIG. 5C. A path 54 is illustrated through which first bracing strut 48 causes third location 52 to rotate about first location 50. In addition, FIG. 5D shows a path 55 through which second bracing strut 49 causes fourth location 53 to rotate about second location 51. The paths 54-55 and the fixed distance 56 between locations 52-53 on those paths illustrate how the struts 48-49 rotate the orientation of headboard frame 21 from parallel to bedboard frame 23 to perpendicular to bedboard frame 23 as headboard frame 21 moves down and around top end 43 of bedboard frame 23.

Figure 5E:
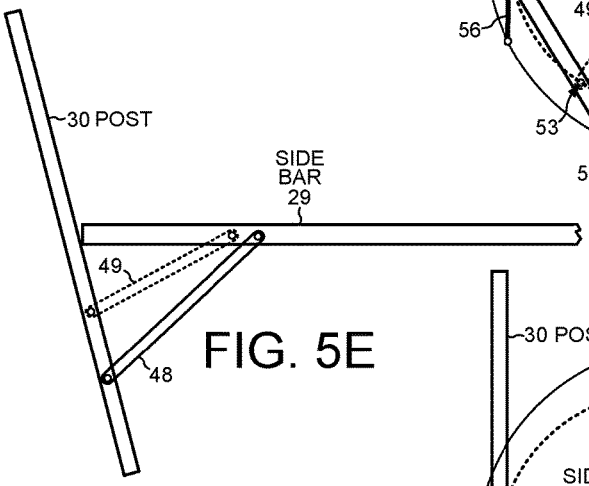
Figure 5F:
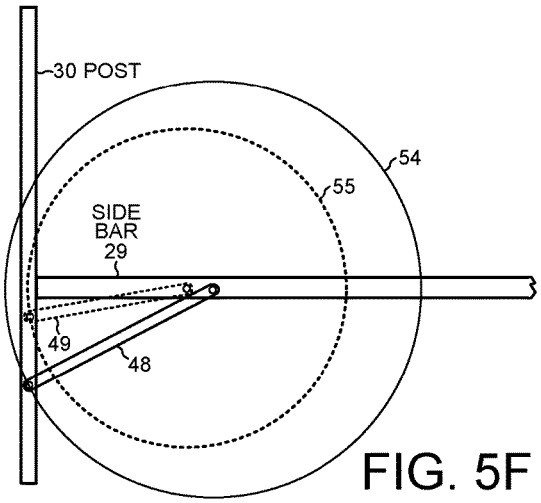

FIG. 5E shows post 30 of headboard frame 21 being folded out and rotated into an almost vertical orientation. And finally FIG. 5F shows headboard frame 21 in the completely unfolded state perpendicular to bedboard frame 21.

Figure 6:
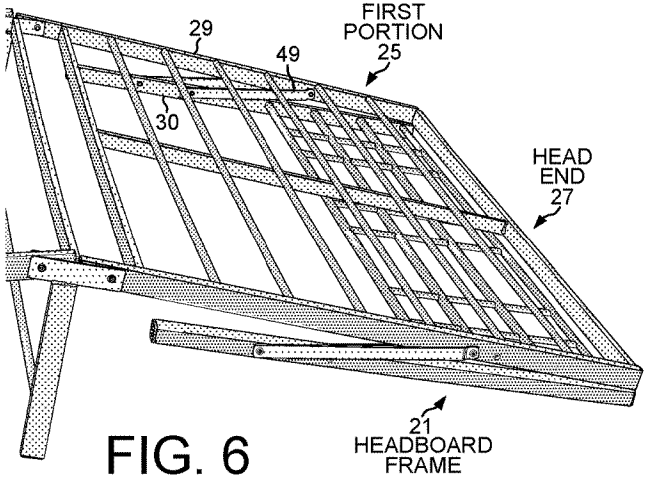
FIG. 6 is a perspective view of the first portion of the bedboard frame as the headboard has just begun to be folded out from under the first portion.

FIG. 6 is a perspective view of first portion 25 of bedboard frame 23 as headboard frame 21 has just begun to be folded out from under first portion 25. The consumer is instructed to stand mattress support 20 on its side after unfolding first portion 25 from second portion 26. Thus, the unfolding step shown in FIG. 6 would preferably be performed by pulling headboard frame 21 from the side away from first portion 25.

Figure 7:
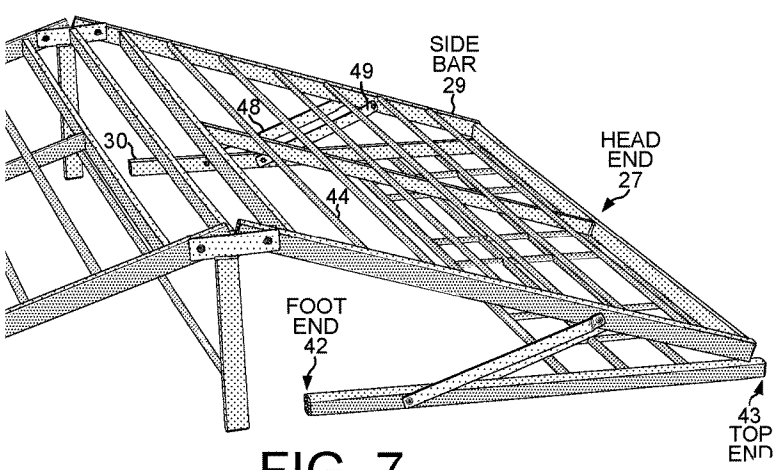
FIG. 7 is a perspective view of the first portion of the bedboard frame as the headboard is folded out farther from under the first portion as illustrated in FIG. 5B.

FIG. 7 is a perspective view of first portion 25 of bedboard frame 23 as headboard frame 21 is unfolded to a degree analogous to that shown in FIG. 5B. In FIG. 7, headboard frame 21 is folded out farther from under first portion 25 than as illustrated in FIG. 6. The relative positions of longer first bracing strut 48 and shorter second bracing strut 49 are shown that connect bar 29 and post 30 beneath the bars 44 of first portion 25.

Figure 8:
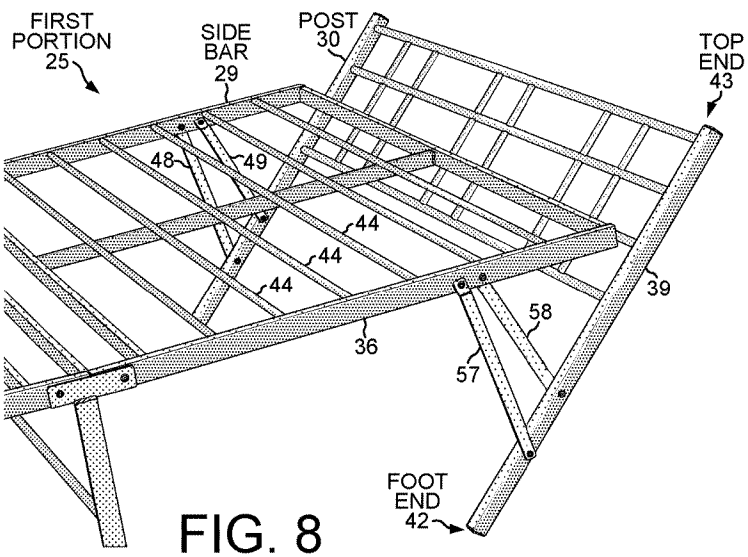
FIG. 8 is a perspective view of the first portion of the bedboard frame as the headboard has been folded out from under the first portion to the position shown in FIG. 5D.

FIG. 8 is a perspective view of first portion 25 of bedboard frame 23 as headboard frame 21 has been folded out from under first portion 25 to a position similar to that shown in FIG. 5D. FIG. 8 shows a longer bracing strut 57 and a shorter bracing strut 58 that connect bar 36 and post 39 on the opposite side of bedboard frame 23 from first bracing strut 48 and second bracing strut 49. Struts 57-58 rotate post 39 in an analogous manner to how struts 48-49 rotate post 30 up and around head end 27 of first portion 25. Bracing struts 48-49 and 57-58 are a means for rotating headboard frame 21 from a collapsed state that is parallel and adjacent to first portion 25 to an unfolded state that is perpendicular to first portion 25 without pivoting headboard frame 21 about any axis whose position is fixed with respect to first portion 25. This allows a taller headboard to be folded completely under first portion 25 so that the collapsed state of foldable mattress support 20 is not wider than the length of the side bars 29 and 36.

Figure 9:
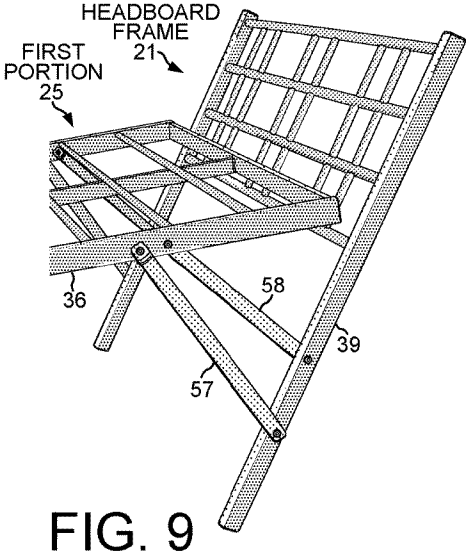
FIG. 9 is a perspective view of the first portion of the bedboard frame as the headboard has been folded out from under the first portion to the position shown in FIG. 5E.

FIG. 9 is a perspective view of first portion 25 of bedboard frame 23 as headboard frame 21 has been folded out from under first portion 25 to a position similar to that shown in FIG. 5E where headboard frame 21 is approaching a vertical orientation.

Figure 10:
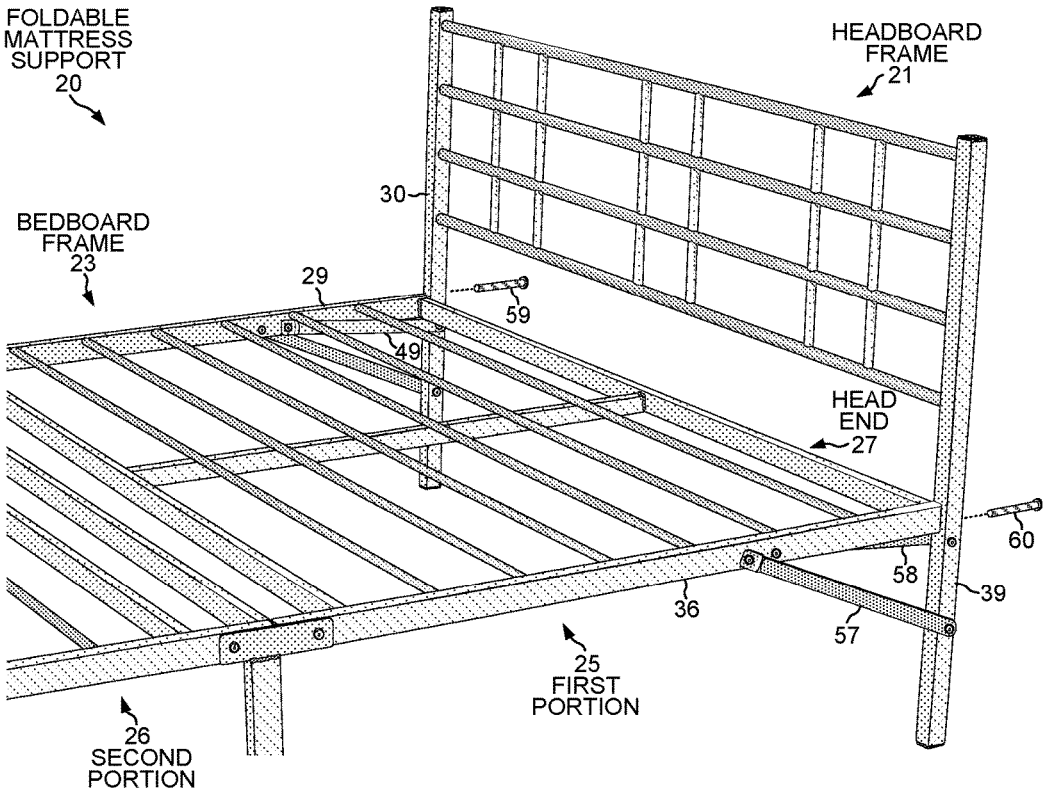
FIG. 10 is a perspective view of the headboard that has been completely unfolded to a position perpendicular to the first portion as shown in FIG. 5F.

FIG. 10 shows foldable mattress support 20 in a completely unfolded state when headboard frame 21 is perpendicular to bedboard frame 23 and the head ends of side bars 29 and 36 of first portion 25 abut the posts 30 and 39 of headboard frame 21. Head end 27 of first portion 25 contacts the posts 30 and 39 of headboard frame 21 at locations that are closer to the foot ends than the top ends of the posts 30 and 39. The consumer is instructed to immovably secure the headboard frame 21 to the bedboard frame 23 in the completely unfolded state by inserting bolts 59-60 through the posts 30 and 39 and screwing them into the ends of the side bars 29 and 36.

Figure 11:
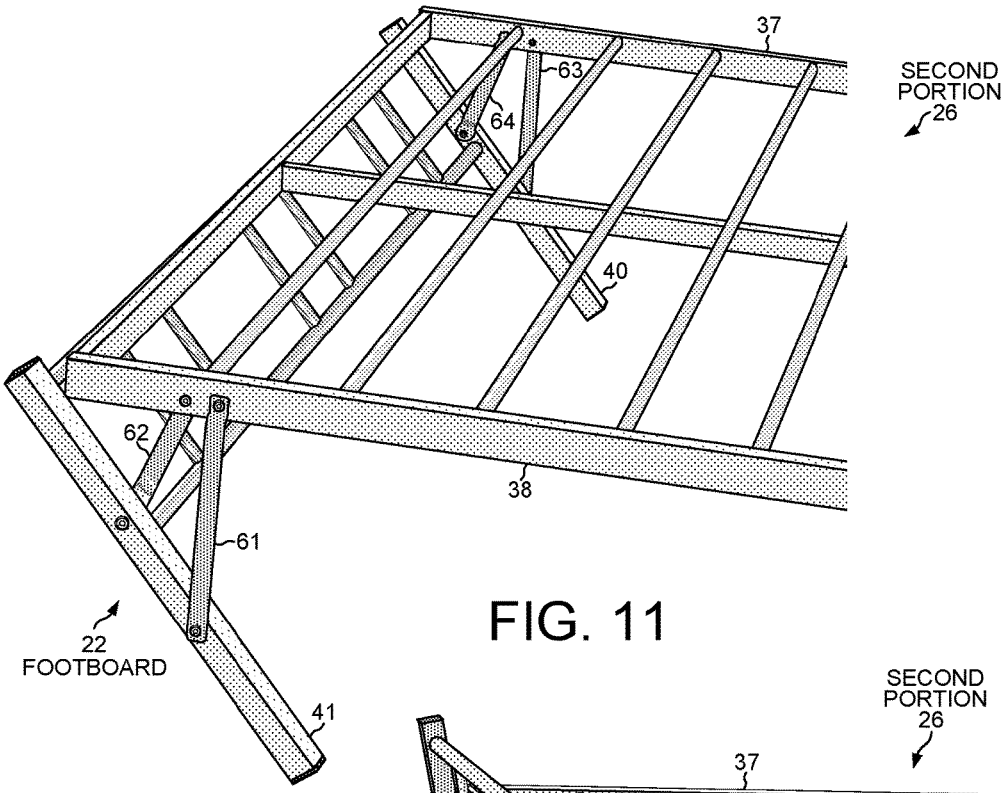
FIG. 11 is a perspective view of the second portion of the bedboard frame as the footboard is folded out from under the second portion.

FIG. 11 is a perspective view of second portion 26 of bedboard frame 23 as footboard 22 is being folded out from under second portion 26. Bracing struts 61-64 are used to rotate footboard 22 from a position parallel and adjacent to second portion 26 to a perpendicular orientation. Bracing struts 61-64 operate on footboard 22 in a manner analogous to how bracing struts 48-49 and 57-58 rotate headboard frame 21.

Figure 12:
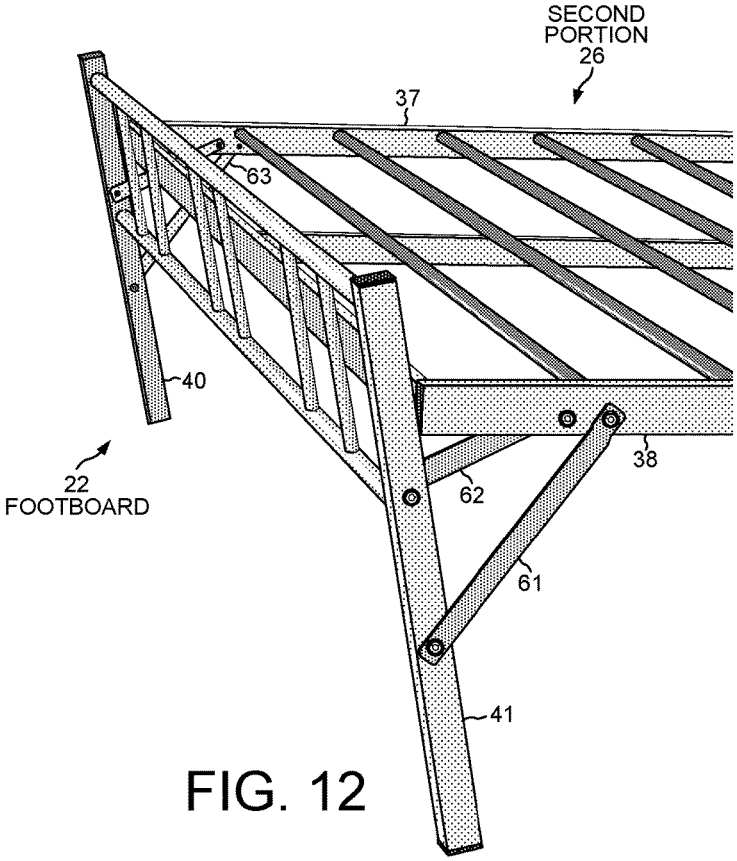
FIG. 12 is a perspective view of the second portion of the bedboard frame as the footboard has been folded out from under the second portion past the position shown in FIG. 11.

FIG. 12 shows second portion 26 of bedboard frame 23 as footboard 22 has been folded out from under second portion 26 past the position shown in FIG. 11 to a nearly perpendicular orientation.

Figure 13:
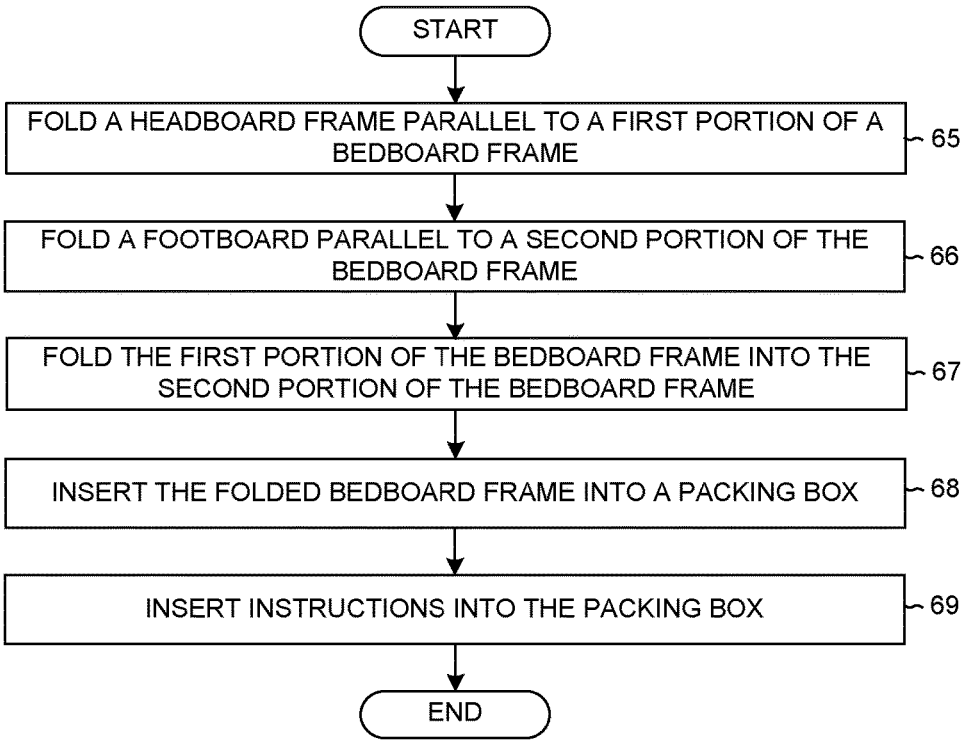
FIG. 13 is a flowchart of steps of a method of making and packaging the foldable mattress support of FIG. 3.

FIG. 13 is a flowchart illustrating steps 65-69 of a method of packing foldable mattress support 20 into a packing box that is conveniently sized for transporting. In a first step 65, headboard frame 21 is folded parallel to first portion 25 of bedboard frame 23. Headboard frame 21 is rotated from a perpendicular orientation to a position parallel and adjacent to the underside of first portion 25 by being folded down and around head end 27 of first portion 25. Headboard frame 21 is folded by means of four bracing struts 48-49 and 57-58. First bracing strut 48 is pivotally attached at first location 50 to first portion 25 and at third location 52 to headboard frame 21. Second bracing 49 strut is pivotally attached at second location 51 to first portion 25 and at fourth location 53 to headboard frame 21. First location 50 is closer to second location 51 than third location 52 is to fourth location 53.

In a second step 66, footboard 22 is folded parallel to second portion 26 of bedboard frame 23. Footboard 22 is folded down and around the foot end of second portion 26 by being rotated from a perpendicular orientation to a position parallel and adjacent to the underside of second portion 26.

In a step 67, first portion 25 of bedboard frame 23 is folded into second portion 26 of bedboard frame 23. First portion 25 and second portion 26 are pivotally attached to central hinge portion 24. Bedboard frame 23 is folded over at two axes the pass through central hinge portion 24. After first portion 25 is folded into second portion 26, headboard frame 21 and footboard 22 are sandwiched between the two portions 25-26, as shown in FIG. 3. In the completely folded state achieved after step 67, the bars 29 and 36-38 and posts 30 and 39-41 are substantially parallel to one another.

In a step 68, the folded bedboard frame 23 as shown in FIG. 3 is inserted into a packing box. The packing box has a length that is slightly longer than the bars 44 and beams 45, and a width that is marginally longer than the side bars 29 and 36-38. The packing box has a height that is slightly greater than the sum of the widths of two bars 29 and 36-38 plus two posts 30 and 39-41.

In a step 69, instructions are inserted into the packing box instructing the user of foldable mattress support 20 how to unfold the folded mattress support after removing it from the packing box. The instructions instruct the user to unfold the folded bedboard frame 23 and to place a mattress on top of the unfolded bedboard frame.

Figure 14:
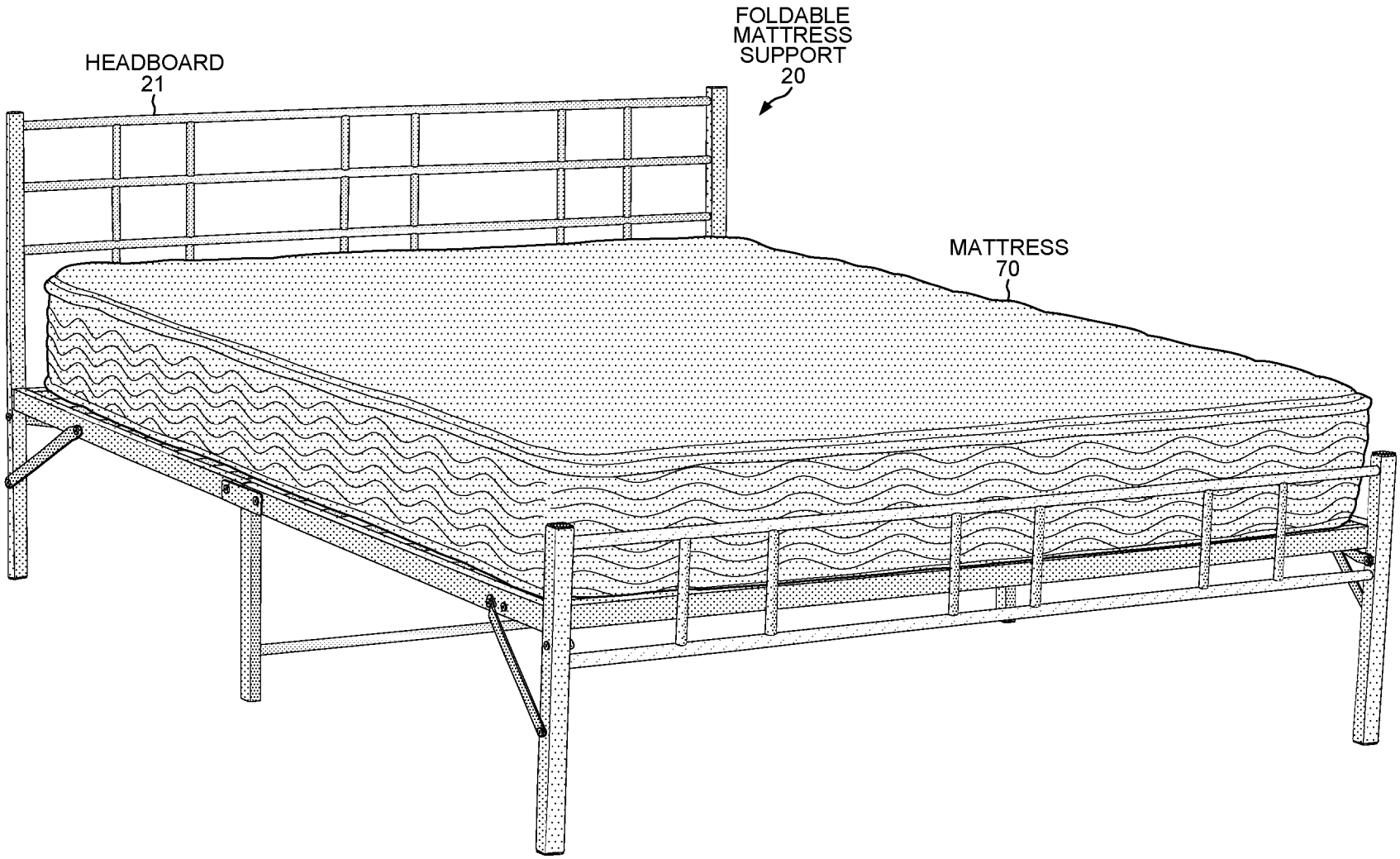
FIG. 14 is a perspective view of the collapsible, foldable mattress support of FIG. 2 upon which a mattress has been placed.

FIG. 14 shows collapsible, foldable mattress support 20 of FIG. 2 upon which a mattress 70 has been placed. By manufacturing the mattress support 20 so that it can fold in half and collapse flat, the mattress support is better suited to sell in mass-market retail stores and can more easily be transported from the store to the location of the mattress to be supported. The large dimensions of a conventional box springs and bed frame take up valuable floor space in mass-market stores. Less floor space is needed to display boxes of the foldable mattress support 20 on store shelves. The large size and unitary construction of a conventional box spring also make it impractical for a consumer to transport the box springs home from a mass-market retail store. The small packing box capable of containing the collapsed mattress support 20, however, can be brought from the store shelf to the check-out counter and then to the trunk of the consumer's car. In addition, the damage that occurs when conventional one-piece wooden box springs are moved through doorways can be avoided. The packing box that contains foldable mattress support 20 can more easily be maneuvered up stairs, into apartment elevators and around corners than would a conventional non-collapsible box springs and a bed frame.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A foldable mattress support comprising:

a bedboard frame with a first portion and a second portion;

a central hinge portion that is pivotally attached to the first portion and the second portion;

a headboard frame; and means for rotating the headboard frame from a collapsed state that is parallel and adjacent to the first portion to an unfolded state that is perpendicular to the first portion without pivoting the headboard frame about any axis whose position is fixed with respect to the first portion.

2. The foldable mattress support of claim 1, wherein the first portion has a head end and a center end, wherein the central hinge portion is pivotally attached to the center end of the first portion, wherein the means comprises a first bracing strut that is pivotally attached at a first location to the first portion and a second bracing strut that is pivotally attached at a second location to the first portion, wherein the second location is closer to the head end than is the first location, and wherein the first bracing strut is longer than the second bracing strut.

3. The foldable mattress support of claim 1, wherein the means is pivotally attached to the first portion both at a first location and at a second location, wherein the means is pivotally attached to the headboard frame both at a third location and at a fourth location, and wherein the first location is closer to the second location than the third location is to the fourth location.

4. The foldable mattress support of claim 1, wherein the headboard frame has a top end and a foot end, wherein the means comprises a first bracing strut that is pivotally attached to the headboard frame at a third location and a second bracing strut that is pivotally attached to the headboard frame at a fourth location, wherein the fourth location is closer to the top end than is the third location, and wherein the first bracing strut is longer than the second bracing strut.

5. The foldable mattress support of claim 1, further comprising:

a footboard frame pivotally attached to a longer bracing strut and a shorter bracing strut, wherein the longer bracing strut and the shorter bracing strut are pivotally attached to the second portion of the bedboard frame.

6. The foldable mattress support of claim 1, wherein the first portion has a head end and a center end, wherein the central hinge portion is pivotally attached to the center end of the first portion, wherein the first portion has a length from the head end to the center end, wherein the headboard frame has a post with a top end and a foot end, and wherein the post is more than three quarters as long as the length of the first portion.

7. The foldable mattress support of claim 1, wherein the first portion has a head end and a center end, wherein the central hinge portion is pivotally attached to the center end of the first portion, wherein the headboard frame has a post with a top end and a foot end, and wherein when the foldable mattress support is in the unfolded state the head end of the first portion contacts the post of the headboard frame at a location that is closer to the foot end than the top end of the post.

8. The foldable mattress support of claim 1, wherein in the collapsed state the first portion of the bedboard frame is parallel to the second portion of the bedboard frame, and the headboard frame is parallel to the first portion of the bedboard frame, wherein the foldable mattress support is disposed in a packing box, and wherein the headboard frame is disposed between the first portion of the bedboard frame and the second portion of the bedboard frame.

9. The foldable mattress support of claim 1, further comprising:

a footboard frame, wherein in the collapsed state the first portion of the bedboard frame is parallel to the headboard frame, and the headboard frame is parallel to the footboard frame, and wherein in the collapsed state both the headboard frame and the footboard frame are disposed between the first portion of the bedboard frame and the second portion of the bedboard frame.

10. The foldable mattress support of claim 1, further comprising:

a footboard frame, wherein in the collapsed state the foldable mattress support is disposed in a packing box, and wherein the packing box has a thickness that is only slightly greater than a sum of widths of the first portion of the bedboard frame, the second portion of the bedboard frame, the headboard frame and the footboard frame.

11. A bed frame comprising:

a bedboard frame adapted to support a mattress;

a footboard frame;

a headboard frame; and means for rotating the headboard frame from a collapsed state that is parallel and adjacent to the bedboard frame to an unfolded state that is perpendicular to the bedboard frame without pivoting the headboard frame about any axis whose position is fixed with respect to the bedboard frame.

12. The bed frame of claim 11, wherein the means includes two metal struts of different lengths.

13. The bed frame of claim 11, wherein the means includes a first bracing strut that is pivotally attached at a first end to the bedboard frame and at a third end to the headboard frame, and wherein the means further includes a second bracing strut that is pivotally attached at a second end to the bedboard frame and at a fourth end to the headboard frame, and wherein the first bracing strut is longer than the second bracing strut.

14. The bed frame of claim 13, wherein the first end of the first bracing strut is attached at a first location to a bar of the bedboard frame, wherein the second end of the second bracing strut is attached at a second location to the bar of the bedboard frame, and wherein the first location and the second location are located on opposite sides of the bar.

15. The bed frame of claim 13, wherein the first end is attached to the bedboard frame at a first location, the second end is attached to the bedboard frame at a second location, the third end is attached to the headboard frame at a third location, and the fourth end is attached to the headboard frame at a fourth location, and wherein the first location is closer to the second location than the third location is to the fourth location.

16. The bed frame of claim 15, wherein the fourth location is closer to a top end of the headboard frame than is the third location.

17. The bed frame of claim 11, wherein the bedboard frame has a head end, wherein the headboard frame has a post with a top end and a foot end, and wherein when the bed frame is in the unfolded state the head end of the bedboard frame contacts the post of the headboard frame at a location that is closer to the foot end than the top end of the post.

18. The bed frame of claim 11, further comprising:

a packing box, wherein the bedboard frame has a first portion and a second portion, wherein in the collapsed state the first portion is parallel to the second portion, and the headboard frame is parallel to the first portion, wherein the bed frame is disposed in the packing box, and wherein the headboard frame is disposed between the first portion and the second portion.

19. The bed frame of claim 11, further comprising:

a footboard frame, wherein the bedboard frame has a first portion and a second portion, wherein in the collapsed state the first portion is parallel to the headboard frame, and the headboard frame is parallel to the footboard frame, and wherein in the collapsed state both the headboard frame and the footboard frame are disposed between the first portion and the second portion.

20. The bed frame of claim 11, further comprising:

a footboard frame, wherein the bedboard frame has a first portion and a second portion, wherein in the collapsed state the bed frame is disposed in a packing box, and wherein the packing box has a thickness that is only slightly greater than a sum of widths of the first portion of the bedboard frame, the second portion of the bedboard frame, the headboard frame and the footboard frame.

* * * * *